US005176362A

United States Patent [19]

Seksaria et al.

[11] Patent Number: 5,176,362

[45] Date of Patent: Jan. 5, 1993

[54] VEHICLE JACK ASSEMBLY

[75] Inventors: Dinesh Seksaria, Murrysville; James D. Klingensmith, Allegheny Township; Glenn W. Jarvis, Allison Park, all of Pa.

[73] Assignee: Aluminum Company of America, Pittsburgh, Pa.

[21] Appl. No.: 691,890

[22] Filed: Apr. 26, 1991

[51] Int. Cl.[5] ..... B66F 3/08

[52] U.S. Cl. ..... 254/126

[58] Field of Search ..... 254/122, 126, 1; 411/301

[56] References Cited

U.S. PATENT DOCUMENTS

| | | | |
|---|---|---|---|
| 2,920,871 | 1/1960 | Kolodin | 254/126 |
| 3,001,567 | 9/1961 | Brill | 411/301 |
| 4,025,054 | 5/1977 | Yamazaki | 254/126 |
| 4,366,948 | 1/1983 | Hafner | 254/126 |
| 4,448,392 | 5/1984 | Ladewski | 254/103 |
| 4,720,082 | 1/1988 | Yang | 254/126 |
| 4,943,034 | 7/1990 | Wagnor | 254/126 |

*Primary Examiner*—Robert C. Watson
*Attorney, Agent, or Firm*—David W. Brownlee

[57] ABSTRACT

A scissor jack having four aluminum arms of U-shaped cross section which are substantially identical and which may include a hollow aluminum lead screw. The threaded nut through which the lead screw is mounted may be made of glass fiber reinforced plastic as may the saddle which is adapted to engage the undercarriage of a vehicle.

13 Claims, 2 Drawing Sheets

FIG. 4
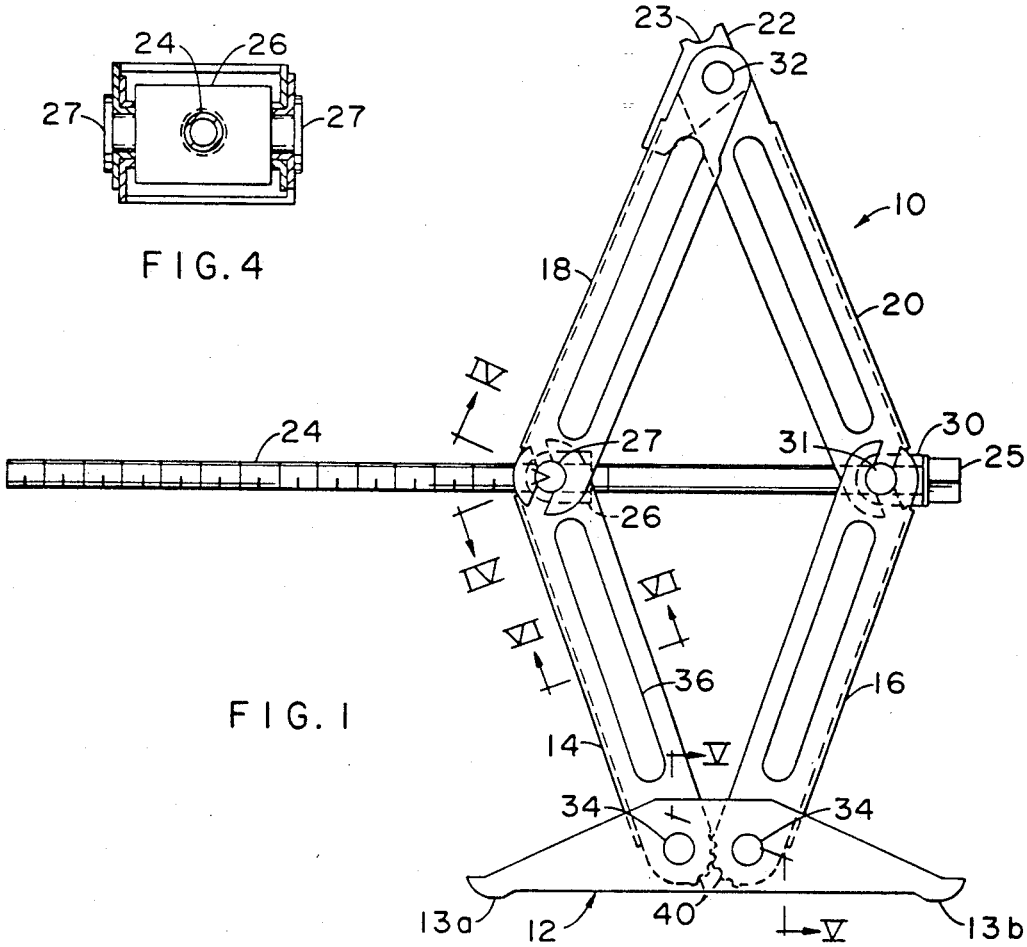
FIG. 1
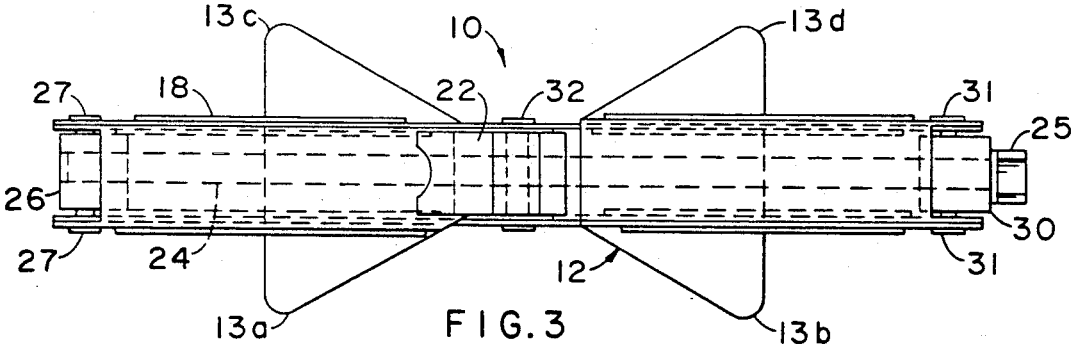
FIG. 3
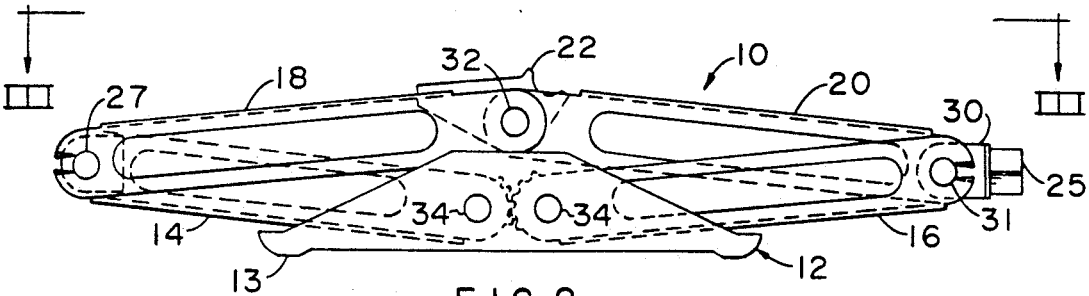
FIG. 2

VEHICLE JACK ASSEMBLY

BACKGROUND OF THE INVENTION

1. Field of the Invention

This invention relates to scissor jacks for lifting vehicles and more particularly to a light weight, compact jack which is inexpensive to manufacture, easy to operate, less prone to squeaking and rattling when stored in a vehicle trunk, less prone to damage the finish of a car, greaseless, and meets other enhanced performance requirements.

2. Description of the Prior Art

The use of scissor jacks to lift a vehicle for changing its wheels, repairs or other needs is well known. Existing scissor jacks have evolved to consist of a combination of links, pins and a lead screw, all generally made from steel. Although these products have provided satisfactory service in the past when lifting load capacity was the only requirement, they do not meet the present requirements of light weight, low cost, small package, low effort in the use, and resistance to rattle/-squeak noises. Vehicle manufacturers today need to provide the users with an ultra light weight jack with the required lift capacity and factors of safety. Also, the extreme shortage of space to store the jack in the trunk of the vehicle demands an efficient, compact package. From the vehicle user's point of view, the lowest possible effort needed to raise the vehicle and to handle the jack from storage is desirable. Vehicle owners also object to the squeaking and rattling of the jack in the trunk of the vehicle.

Some examples of prior art jacks include the jack disclosed in U.S. Pat. No. 4,025,054 to Yamazaki which is a pantographic jack having two pairs of arms which include gear teeth portions on the ends of the arms. The gear teeth portions are formed integrally with the arms and extend at a right angle therefrom. The arms in Yamazaki's jack are of U-shape configuration and the teeth on the gears are formed from the flanges of the U-shape arms.

Engels U.S. Pat. No. 4,802,653 discloses a scissor jack which is formed with a base and four channel shaped link members and a threaded shaft for raising and lowering the jack. Engels' invention relates to a quicker and easier way to assemble the jack due to the use of slots in the ends of the arms for receiving the rivets which hold the jack together.

Yamayuchi et al U.S. Pat. No. 4,848,733 discloses a vehicle jack assembly having a pantographic mechanism carrying a head bracket for engaging a lower surface portion of a vehicle body. The jack has upper arms and lower arms which are of channel shaped cross section and utilizes a screw shaft for raising and lowering the head bracket of the jack. Billingsley U.S. Pat. No. 1,376,507 discloses a four piece scissor jack wherein the four pieces are of similar construction and have toothed end portions for engaging one another. Billingsley's lead screw has a right hand thread on one end and a left hand thread on the other end.

Other discloses of interest are contained in Steppon U.S. Pat. No. 3,317,189; Kolodin U.S. Pat. No. 2,920,871; Curran U.S. Pat. No. 1,994,015; Larsen U.S. Pat. No. 1,736,202; and Peck U.S. Pat. No. 2,580,829.

Despite the efforts made by prior inventors, there continues to be a need for an ultra light weight jack with the required lift capability and factors of safety necessary for the user. There is also a need for such jack to be low cost and compact, as well as have a low required effort for use and be quiet when stored in the vehicle trunk.

SUMMARY OF THE INVENTION

The present invention provides an improved scissor jack in which the four arms which form the pantographic mechanism all have substantially identical U-shaped cross sections and are of substantially identical length. In one embodiment all four arms are identical, and in the other embodiment the two upper arms are identical and the two lower arms are identical. The arms are preferably made of high strength aluminum alloy, as is the lead screw which is preferably an externally threaded, hollow aluminum extrusion. Construction of the arms of identical cross sectional shape permits production of the arms on fast continuous type manufacturing processes and reduces the cost of manufacture and assembly. A jack of this invention further utilizes glass reinforced plastic material to form the saddle for engagement against the undercarriage of a vehicle and also to form the nut which is engaged by the lead screw. The use of glass fiber reinforced plastic has several advantages including light weight, less damage to the vehicle undercarriage, less resistance to raising the jack, greaseless or substantially greaseless, and reduction in squeaks and rattles when the jack is stored in the vehicle trunk.

Accordingly, an object of this invention is to provide a light weight, low cost, compact jack that is easy to use and safe for the user.

Another object of this invention is to provide a scissor jack that can be quickly and easily assembled by the manufacturer.

Other objects, features and other advantages of the invention will become readily apparent from the following description of certain preferred embodiments thereof taken in conjunction with the accompanying drawings, although variations and modifications may be effected without departing from the spirit and scope of the novel concepts of the disclosure.

BRIEF DESCRIPTION OF THE DRAWINGS

FIG. 1 is a side elevation view of one embodiment of a scissor jack of this invention showing the jack in the expanded or elevated position.

FIG. 2 is a side elevation of the same jack as shown in FIG. 1 with the jack in the collapsed position.

FIG. 3 is a top plan view of the jack of FIGS. 1 and 2.

FIG. 4 is a cross sectional view taken on line IV—IV of FIG. 1.

DESCRIPTION OF THE PREFERRED EMBODIMENTS

Figure 5:
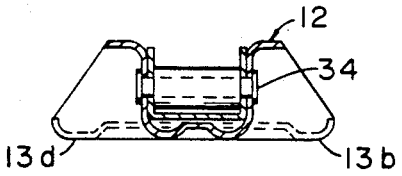
FIG. 5 is a cross sectional view taken on line V—V of FIG. 1.

FIG. 1 shows a preferred embodiment of a jack 10 of this invention as including a base plate 12 made from an aluminum alloy sheet or plate that is shaped in the form shown, four arms 14, 16, 18, 20, a saddle 22 for engaging on the undercarriage of a vehicle, and a lead screw 24 for operating the jack.

The base plate is constructed such that the outside or lower surface 13 which contacts the ground or pavement during operation of the jack provides sufficient stability for the lifting operation. For lifting the average, mid-size car manufactured today, it has been found that four contact surfaces 13*a*, 13*b*, 13*c*, 13*d* spaced in a rectangle approximately 8 inches by $4\frac{3}{4}$ inches are adequate to meet the stability requirement in lifting. The dimensions vary depending on the car for which the jack is designed and the performance specifications.

In accordance with this invention, the four arms 14, 16, 18, 20 are all preferably made from aluminum which is not only light weight, but also avoids unsightly rust and corrosion as well as eliminates the need and cost of painting the jack. The aluminum alloy must have high yield strength and formability. It should have a yield strength of at least 40 ksi, and preferably 46 ksi, and an elongation of 10%, and preferably 13–14%. 6013-T6 aluminum alloy is preferred.

Figure 6:
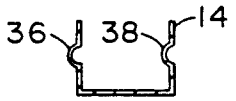
FIG. 6 is a cross sectional view taken on line VI—VI of FIG. 1.

The arms are all of essentially identical configuration in that they have identical cross sectional shapes (FIG. 6) and preferably of identical length and may vary only in the shape of their ends for interengagement. Thus, the arms can be cut from a common, long length aluminum channel, thereby reducing the manufacturing costs and the needs for stocking dissimilar inventory. The two lower arms 14 and 16 are pivotably engaged with the base plate 12 with pins 34 as best illustrated in FIG. 5. The two upper arms 18 and 20 are pivotably connected to the saddle 22 by means of a pin 32. The recess 23 in the saddle 22 of FIG. 1 will rotate in a counterclockwise direction as the upper arms are raised away from the base. This recess is positioned such that its arc of travel during such raising and rotation is the same as that of the vehicle that is being raised. This reduces the severity of the horizontal force component on the jack, maximizing the stability achieved by the vertical force component, and makes it safer as it is less likely to slip.

The upper and lower arms are interconnected at their adjacent ends by the plastic nut 26 illustrated in FIG. 4 and by a mounting block 30. The nut 26 has heads 27 on opposite ends, and the block 30 has similar heads 31 for fitting in the slotted ends of the arms 14, 16, 18 and 20. The block 30 looks like the nut 26 except it has an unthreaded bore through it. The lead screw 24 passes through the mounting block 30 and through the nut 26 to join the opposite sides of the jack in a way that permits raising of or lowering of the jack by rotation of the lead screw. The lead screw 24 may be made from lower strength steel with one end 25 headed to accept the same lug wrench that is used for the wheel nuts on the vehicle.

The nuts 26 and 30 are preferably molded from glass fiber reinforced plastic (GFRP) to save weight as well as eliminate problems of rattles and squeaks without adding significantly to the cost of the jack. The use of specifically selected GFRP composite materials in the nut also reduces the effort required to turn the lead screw to raise the vehicle and should eliminate the need for the application of messy grease or oil to the lead screw which many users find undesirable.

The lower arms 14 and 16 have gear teeth 40 formed on the lower ends thereof, interengaged so that the arms are compelled to move complimentarily and maintain the same angular relationship. The teeth are preferably formed integrally from the flanges on the arms as is known in the industry. The teeth may be either blanked from the flanges and not be reinforced, or they may be reinforced by additional thickening or lamination. The teeth may also be formed in a separate part attached to the ends of the arms. Such parts could be GFRP.

All four arms 14, 16, 18, 20 preferably have longitudinally extending ribs 36 and 38 embossed in both opposed flanges to reinforce and strengthen the arms. It has been found that such ribs 36 and 38 increase the axial load capability of a $6\frac{3}{4}$ inch long channel of 0.080 inch gauge aluminum alloy 6013-T6. The gauge of aluminum may be in the range of 0.060 to 0.125 inch, depending on the other dimensions, the alloy and the performance requirements. The ribs terminate short of the ends of the arms so as not to interfere with the interengagement and nesting of the arms at their interconnections with each other and with the base plate and the saddle. The lower ends of the upper arms 18, 20 and the upper ends of the lower arms 14, 16 are preferably slotted to receive the fastening pins as will be explained.

Figure 9:
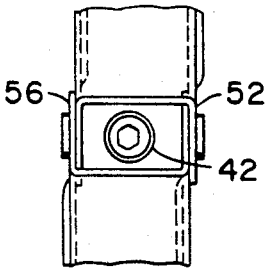
FIG. 9 is a fragmentary elevation view taken on line IX—IX of FIG. 7 showing the end of the lead screw.

In accordance with this invention, the adjacent interconnected arms are offset laterally with respect to one another so that the flanges at the interconnections of one arm to another will overlap and not interfere with such interconnection. Such overlap of the flanges is illustrated in FIG. 4 showing the first embodiment, and in FIG. 9 of an alternative embodiment of the invention. As best shown in FIG. 9 which shows the ends of the arms 52 and 56, one flange of one arm nests inside the channel, while the other flange nests outside the channel. Such nesting arrangement allows full collapse of the interconnected arms, which are of the same structure. Prior art jacks typically had one arm constructed of a smaller channel which nested entirely inside the mating channel upon collapse.

Figure 7:
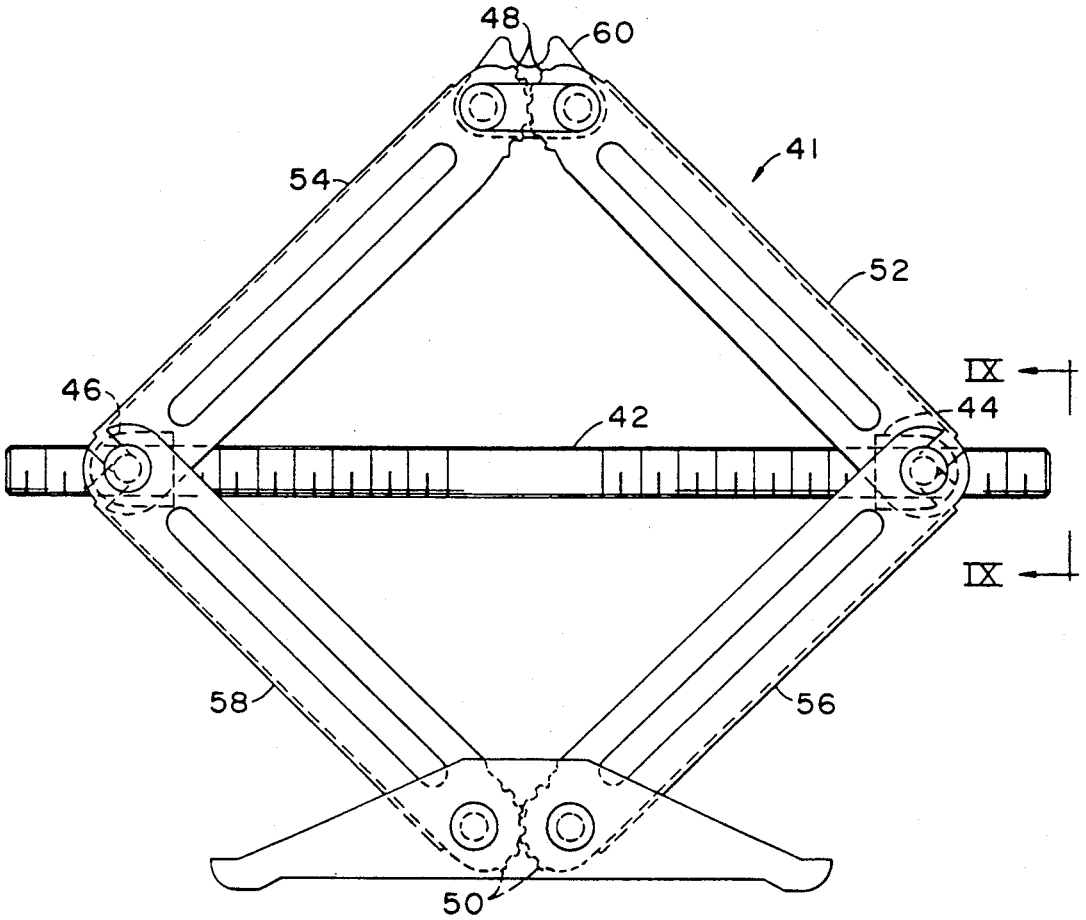
FIG. 7 is a side elevation view of an alternative embodiment of a scissor jack of this invention with the jack in a raised position.

FIG. 7 shows an alternative embodiment 41 of the invention which utilizes a lead screw 42 having right hand threads on one end and left hand threads on the other end and which uses a nut at both of the connections between the upper and lower arms so that the lead screw will advance simultaneously through both such nuts 44, 46 in opposite directions upon rotation of the lead screw. The embodiment of FIG. 7 also includes engaging gear teeth 48 between the ends of the upper arms 52, 54 as well as teeth 50 between the ends of the lower arms 56, 58 of the jack. The use of such gear teeth on all four arms means that the structure of each of the arms, including the end portions, can thus be identical. The gear teeth at the top as well as at the bottom of the jack also produce a directly vertical travel of the saddle on the jack during raising or lowering thereof.

The embodiment of FIG. 7 further includes a lead screw which is hollow and has a hexagonal inside shape adapted to receive a hexagonal tool for rotation of the lead screw. This is best shown in FIG. 9. Such an embodiment reduces the length of the lead screw by the length of the hexagonal head that would otherwise be provided, and is therefore lighter and less expensive. In a preferred embodiment the lead screw is made of hollow, extruded high strength aluminum alloy such as aluminum alloy 6061-T6. The end of such hollow extrusion is worked to accommodate whichever tool is to be available for use in turning the lead screw.

Figure 8:
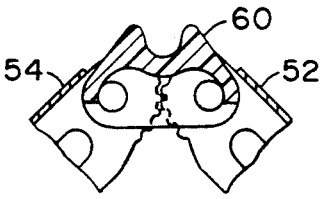
FIG. 8 is a partially fragmented view of the saddle support of FIG. 7.

FIG. 8 illustrates a preferred shape of the glass fiber reinforced plastic saddle 60 for the jack. Saddles made of such material are light weight and relatively inexpensive. The GFRP is also less likely to mar the surface finish of a vehicle body during use. In addition, the plastic saddle is bottomed out against the lead screw in the storage position and does not tend to damage the lead screw threads, and the GFRP material is less likely to produce rattles and squeaks during storage as is otherwise likely with metal to metal contact parts. The symmetric geometry of the linkage shown in FIG. 7 causes the saddle 60 to traverse a truly vertical movement with respect to the base giving it a secure and safe connection to the vehicle being raised.

In an embodiment of this invention which is designed for a sports car with a 14 inch wheel base, long length channels of aluminum alloy 6013 T6 are made by bending aluminum sheet of 0.080 inch gauge into a channel structure. A reinforcing rib is typically provided along the length of both flanges of the long length channel Arms, each approximately 6¾ inches in length, are cut from the long length channel and passed through an end forming and preparation operation to provide apertures and/or cut or stamp the gear teeth at the end portions. Such finished arms are typically 6¾ inches in length. External threads are formed on or cut into the outside surface of an extruded aluminum lead screw 14 inches in length. The threads in one embodiment have a pitch of 10 threads per inch, but may have other pitches depending on the requirement in ease of operation or rate of lifting. The threads are formed to a depth as specified by SAE or other industry standards. The scissor jack is assembled by first connecting the two upper arms to the saddle. The lead screw and nuts are also assembled as a subassembly. The subassembly of the upper arms and saddle is placed in a fixture which holds the arms at an appropriate angle. The lead screw and nut subassembly is put in place by slipping the pin nuts into the slots in the ends of the upper arms. The lower arms are next put into place by slipping the heads on the nuts into the slots in the upper ends of the arms. The lower arms are then secured to the base of the jack. Once this is done, the jack is secure against falling apart despite the slots in the ends of the arms. This is because the slots are at an angle to the axis of the jack that prevents disassembly except by first removing the pins holding the lower arms to the base. In its collapsed position the jack occupies a space 14–15 inches in length, 4¾ inches in width at the widest point, and a height of less than 3 inches. Its total weight is about 2–3 pounds. This is significant considering the premium on space in a trunk, and considering that a one pound reduction may provide as much as 0.01 mile per gallon fuel savings for some cars.

Vehicle jacks constructed in accordance with this invention weigh approximately one-half that of the jacks currently produced with equivalent lifting load capacity. Jacks of this invention also utilize far fewer parts and are more economical to produce than equivalent jacks presently on the market. The jack illustrated in FIG. 7 is even smaller than the jack of FIG. 1 with even fewer parts and has a slightly higher lift capacity than the jack of FIG. 1 for about the same unit weight.

What is claimed is:

1. In a scissor jack for a vehicle which includes a sheet metal base;

a saddle for engaging the undercarriage of a vehicle body;

a pair of lower arms, each of which has a bottom end thereof rotatably connected to said base and having gear teeth thereon in meshing engagement;

a pair of upper arms, each of which has a top end thereof rotatably connected to said saddle and having the bottom end thereof pivotably connected to the top end of one of said lower arms to form a pantographic mechanism;

a threaded nut between the connection of one of said lower arms and an upper arm; and a threaded lead screw spanning the pantographic mechanism between the connections of the upper and lower arms and adapted to very the spacing between said connections to raise and lower said saddle with respect to said base;

the improvement comprising said upper and lower arms having substantially identical U-shaped cross sections and substantially identical lengths, said upper and lower interconnected arms are offset laterally with respect to each other a distance equal to the thickness of one of said flanges so that flanges of the U-shape cross section are parallel and overlap at the interconnections, whereby arms having substantially identical dimensions in cross section nest together when the jack is collapsed, a non-rotatable threaded nut between both connections of a lower arm to an upper arm, and said lead screw having a left hand thread provided on the outside surface of the lead screw at one end and a right hand thread provided on the outside surface of the lead screw at the other end.

2. A jack as set forth in claim 1 in which said arms are made of high yield strength and formable aluminum alloy.

3. A jack as set forth in claim 1 in which said lead screw is a hollow aluminum extrusion.

4. A jack as set forth in claim 1 in which the inside of the lead screw is hexagonal in shape for receiving a hexagonal Allen tool to turn the screw.

5. A jack as set forth in claim 1 in which said nut is made of molded glass fiber reinforced plastic.

6. A jack as set forth in claim 1 in which said upper arms have gear teeth on their top ends which are in meshing engagement.

7. A scissor jack for a vehicle which includes a sheet metal base;

a saddle for engaging the undercarriage of a vehicle body;

a pair of substantially identical lower arms of U-shaped cross section, each of which has a bottom end thereof rotatably connected to said base and having gear teeth thereon in meshing engagement;

a pair of substantially identical upper arms of U-shaped cross section, each of which has a top end thereof rotatably connected to said saddle, gear teeth on the top end of each upper arm in meshing engagement, and having the bottom end thereof pivotally connected to the top end of one of said lower arms to form a pantographic mechanism and said upper and lower interconnected arms are offset laterally with respect to each other a distance of at lest the thickness of one of said flanges so the flanges of the U-shape cross section are parallel and overlap at the interconnections, whereby arms having substantially identical dimensions in cross section nest together when the jack is collapsed;

a non-rotatable threaded nut between the connection of each of said lower arms and said upper arms; and a threaded lead screw spanning he pantographic mechanism between the connections of the upper and lower arms and adapted to vary the spacing between said connections to raise and lower said saddle with respect to said base, said lead screw having a left hand thread provided on the outside surface of the lead screw at one end and a right hand thread provided on the outside surface of the lead screw at the other end, being hollow and having a hexagonal inner surface on at least the end thereof for receiving a hexagonal Allen tool to turn the crew.

8. A jack as set forth in claim 7 in which said arms are made of high yield strength aluminum alloy.

9. A jack as set forth in claim 7 in which said nut is made of molded glass fiber reinforced plastic.

10. A jack as set forth in claim 7 in which said saddle is made of glass fiber reinforced plastic.

11. A scissor jack for a vehicle which includes a base made of aluminum sheet;

a fiber glass reinforced plastic saddle for engaging the undercarriage of a vehicle body;

a pair of substantially identical lower high yield strength aluminum alloy arms of U-shaped cross section each of which has a bottom end thereof rotatably connected to said base and having gear teeth thereon in meshing engagement;

a pair of substantially identical upper high yield strength aluminum alloy arms of U-shaped cross section each of which has a top end thereof rotatably connected to said saddle, gear teeth on eh top end of each upper arm in meshing engagement, and having the bottom end thereof pivotably connected to the top end of one of said lower arms to form a pantographic mechanism and said upper and lower interconnected arms are offset laterally with respect to each other a distance of at least the thickness of one of said flanges so the flanges of the U-shape cross sections are parallel and overlap at the interconnections whereby arms having substantially identical dimensions in cross section nest together when the jack is collapsed;

a non-rotatable threaded nut of molded glass fiber reinforced plastic between the connection of each of said lower rams and said upper arms; and a hollow aluminum threaded lead screw spanning the pantographic mechanism between the connections of the upper and lower arms and adapted to vary the spacing between said connections to raise and lower said saddle with respect to said base, said lead screw having a left hand thread provided on the outside surface of the lead screw at one end and a right hand thread provided on the outside surface of the lead screw at the other end.

12. A jack as set forth in claim 11, in which the inside of the lead screw is hexagonal in shape for receiving a hexagonal Allen tool to turn the screw.

13. A jack as set forth in claim 11 in which said upper and lower arms have identical shapes and dimensions.

* * * * *